US006257461B1

(12) United States Patent
Fuchs

(10) Patent No.: US 6,257,461 B1
(45) **Date of Patent: *Jul. 10, 2001**

(54) MEDIA DISPENSER HAVING PARTS WITH SHEAR FACES FOR FACILITATING ASSEMBLY

(75) Inventor: Karl-Heinz Fuchs, Radolfzell (DE)

(73) Assignee: Ing. Erich Pfeiffer GmbH, Radolfzell (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/274,835

(22) Filed: Mar. 23, 1999

(30) Foreign Application Priority Data

Mar. 25, 1998 (DE) ..... 198 13 078

(51) Int. Cl.[7] ..... B67D 5/40

(52) U.S. Cl. ..... 222/383.1; 222/541.5; 222/541.9

(58) Field of Search ..... 222/383.1, 541.5, 222/541.6, 541.9

(56) References Cited

U.S. PATENT DOCUMENTS

| | | | | |
|---|---|---|---|---|
| 3,254,807 | | 6/1966 | Boch et al. | 222/394 |
| 3,685,933 | | 8/1972 | Schneider | 425/109 |
| 3,963,153 | * | 6/1976 | Bly | 222/541.9 |
| 4,079,865 | | 3/1978 | Kutik | 222/259 |
| 4,162,742 | * | 7/1979 | Vogt | 222/541.6 |
| 5,054,692 | | 10/1991 | Foster et al. | 239/589 |
| 5,657,907 | * | 8/1997 | Dobbs et al. | 222/383.1 |
| 5,738,251 | * | 4/1998 | Schuckmann | 222/383.1 |
| 5,755,384 | * | 5/1998 | Foster et al. | 222/383.1 |
| 5,813,570 | | 9/1998 | Fuchs et al. | 222/82 |
| 5,992,704 | | 11/1999 | Jäger-Waldau | 222/341 |

FOREIGN PATENT DOCUMENTS

| | | |
|---|---|---|
| 70 07 323 GM | 6/1969 | (DE) . |
| 78 06 846 U | 5/1978 | (DE) . |
| AT E 29 426 | 1/1988 | (DE) . |
| 38 19 762 A | 12/1989 | (DE) . |
| 44 12 041 A | 10/1995 | (DE) . |
| 44 26 120 A | 1/1996 | (DE) . |
| 196 24 907 A | 6/1997 | (DE) . |
| 197 00 437 A | 7/1997 | (DE) . |
| 196 05 153 | 8/1997 | (DE) . |
| 196 06 701 A | 8/1997 | (DE) . |
| 196 07 691 | 9/1997 | (DE) . |
| 196 37 101 | 3/1998 | (DE) . |
| 03 09 010 A | 7/1988 | (EP) . |
| 12 71 677 | 3/1964 | (FR) . |
| 2206176 | 10/1973 | (FR) . |
| 956643 | 4/1963 | (GB) . |
| 1062481 | 4/1964 | (GB) . |

OTHER PUBLICATIONS

German Patent Office search report on German patent application No. 109 13 078.3, dated Apr. 20, 1999.

* cited by examiner

*Primary Examiner*—Joseph A. Kaufman
(74) *Attorney, Agent, or Firm*—Quarles & Brady LLP

(57) ABSTRACT

Two components (2, 3) of a medium dispenser are initially injection molded from a plastics material in one part so as to form a stamp die (6) and a punching ram (7) while being interconnected only by ultra-fine joints (4, 30). The component (3) forming the ram (7) is then linearly displaced in direction (12) into the other component (2) by pressure loading. Thus the joint (4, 30) is severed analogous to shear cutting. This results in very simple production with precisely the same material quality of both components (2, 3).

29 Claims, 1 Drawing Sheet

MEDIA DISPENSER HAVING PARTS WITH SHEAR FACES FOR FACILITATING ASSEMBLY

TECHNICAL FIELD AND BACKGROUND OF THE INVENTION

The invention relates to media dispensers and to methods for producing a dispenser unit or other workpiece. Such media may be pellets or fluid media, such as gaseous, liquid, pasty, creamy or powdery, i.e. trickling media. The dispenser is held single-handedly and actuated simultaneously by the same hand to discharge the medium. It may be provided merely for a single medium discharge or for any number of repeated discharges, e.g. by it automatically returning to its initial or rest position after each discharge. Most or all components of the dispenser are composed of plastics or as injection-molded parts insensitive to the medium.

Usually the cooperating and thus complicated components of the dispenser are produced separately and then assembled, involving corresponding expenditure. This often also applies when the components are produced in one part and then dismembered before being assembled. It is therefore advantageous to produce or cast the components integral as a module, to then avoid dismembering and to directly transfer the components from their mutual production posture or casting position into their mutual operating posture. In this positon the components are either mutually movable, i.e. able to assume numerous operating positions or they may be rigidly interconnected. When so produced, fragments or ridges of the severed joint or nominal severing point may interfere, e.g. by damaging the guiding faces or others with their division faces when transferring the two components. Also the division or fracture faces may have differing, for example, jagged shapes for which a corresponding accommodating space needs to be created in the operating posture.

OBJECTS OF THE INVENTION

An object of the invention is to provide a dispenser or a method for producing a module which obviates the disadvantages of prior art constructions or as described. Another object is to achieve the cited advantages. A further object is to achieve precisely definable parting faces when severing the joint. A still further object is to permit simple production. Another object is to make the dispenser functionally reliable.

SUMMARY OF THE INVENTION

According to the invention the severable joint between the two components is separated by shearing or any other equivalent disconnecting procedure. Thereby the cutting force flow in the joint while being severed leads to a crack-free or smooth parting face without release of particles because of slight plastification of the connecting material. This is particularly assured when the maximum transverse strain reaches only the yield point of the connecting material. Contrary thereto the parting face may be grainy and rough in a stress condition in which the higher shear breaking limit is reached. It is particularly simple to achieve this shear cutting when the two components are configured like the punch and die of a stamp.

The invention is suitable for numerous components of a dispenser or other workpieces. For example, the components may be two casing parts, such as a main casing and a cover of a pressure cylinder, pump, valve, piston unit, discharge head or the like or two valve elements. Furthermore, the components may be sections of a medium duct. The components may be divided or reciprocally transferable into the operating posture transverse respective parallel to their axis.

The invention is particularly useful for an outlet or nozzle unit, the nested components or nozzle bodies of which serve to transversely deflect the medium once or more times. Reference is made to U.S. Ser. No. 794,983 (filed: Feb. 5, 1997) for including the features and effects in the present invention.

The connecting member joining the two components in the first position, namely in production, is a projection directly connecting in one part to two smooth and mutually angular faces of the two components. The connecting member extends up to the common corner zone of these faces and connects these faces via an inclined surface which may be planar, concave or convex. Cross-sectionally this projection is thus triangular or isosceleous. The legs of the projection adjoin the cited flange facings of the two components.

The connecting member is spaced from one or both remote faces of the individual component, which transversely adjoin the associated flange or connecting face. Thus no ruptured faces occur when severed at these faces. The edges commonly formed by these faces and the connecting face may, however, in the casting state directly adjoin the associated edges of the other component similar to a microthin joint. This joint has, as compared to the connecting member, significantly less strength, such as shear strength, so that it may be parted by shearing or shear cutting practically without additional need of force and may be already parted when the connecting member is not yet entirely severed. Only a single connecting member is or opposing connecting members are provided on two mutually opposing sides. Such connecting members are absent on the sides oriented transverse thereto which may only have the microthin joints. The microthin joint may thus be arcuated or annularly closed. Thereby interconnected edges of the two components extend directly up to each other at a sharp angle. Thus in cross-section the associated internal surface of the one component transits linearly into the associated external surface of the other component at the butt joint of these two edges.

The largest cross-section of the connecting member measures less than two, one, half or two-tenths of a millimeter. The length of the cited joining legs may be e.g. a tenth of a millimeter. Over its length the connecting member has constant cross-sections. This length too amounts less than one of the values cited, particularly a third of a millimeter. Thus the latter length is greater than all cross-sectional edge dimensions of the connecting member. A suitable material is polyethene or a material having similar properties.

For operationally positionally securing the components catch or snap members are provided. When attaining the operating posture these members resiliently snap back into mutual positive engagement. Prior to attaining this working or operating posture these members mutually resiliently urge each other back. Thereby only one snap member may be resilient whilst the other remains rigidly positioned.

In the operating posture the individual component may also be positionally secured by abutting on the other component. This stop can act counter the locking action of the catch member. The stop of the one component comes into engaging contact with the other component only on a very last and small portion of the entire displacement path.

The adjoining corner edges of the two components or the associated microjoint may also not be annular, i.e., interrupted along an edge which is non-angled continuous. Correspondingly, the guide opening serving as the cutting socket or die may be cross-sectinally open on this side, i.e. in the casting state thus that the internally received component is not at all guided on this side over a first portion of the displacement path and then enters a guiding part which positively guides the component also on this side. In a transverse view this guiding side may be overlapped on the left and right by guide projections, whilst being freely exposed inbetween. Thus a medium passage is formed between the guide projections. This passage emanates from the opposite guiding face of the receiving component and traverses the received component, namely straight. The medium can flow along between these guiding faces of the two components.

In a preferred arrangement the connecting member is left only on a sole of the components, after severing, particularly on the received component. The division face of the other component then serves over the full displacement path firstly as a sliding face and then for positionally holding the counter component by permanently resting on this member in the operating posture. For this and the other effects cited the cold-flow properties of the material used are selected accordingly. The largest and smallest edge or width dimensions, as measured transverse to the shifting direction at the connecting zone of the received component, may be at the most thirty, twenty, ten or five millimeters, and at least five, three, two millimeters or one millimeter. This component may thus form a tab which is non-destructively flexibly or elastically bendable. In the operating posture this component is then stiffened by the other component to be non-bendable. The smallest width of a medium duct traversing each of the components may be less than three, two, one or half a millimeter or may be conical at an angle of less than 5° or 20°. Thus this duct is suitable as an atomizing nozzle which either forms the medium outlet directly porting to the environment or is spaced upstream therefrom.

A method according to the invention includes casting or molding the components in one part in an injection mold whereafter they remain continually mutually interconnected but are transferred from the first postion or casting state directly into a second position or operating posture. Instead of being produced in a continuously common mold cavity, the two components may also be produced in separate mold cavities or without direct interconnection, whereafter the components are transferred into the first position and from there into the second position.

BRIEF DESCRIPTION OF THE DRAWINGS

Example embodiments of the invention are explained in more detail in the following and illustrated in the drawings in which.

DETAILED DESCRIPTION

Figure 1:
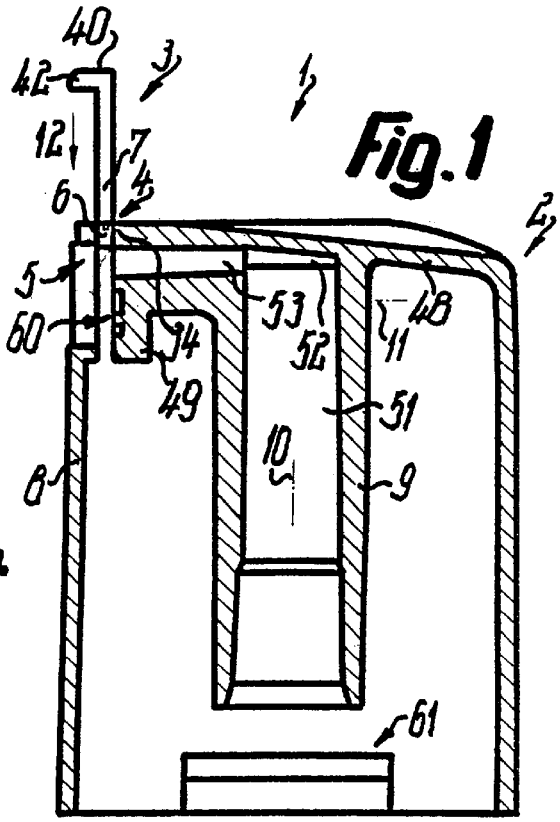
FIG. 1 is a module according to the invention in an axial cross-section through a discharge or actuating head when in the casting state.
Figure 5:
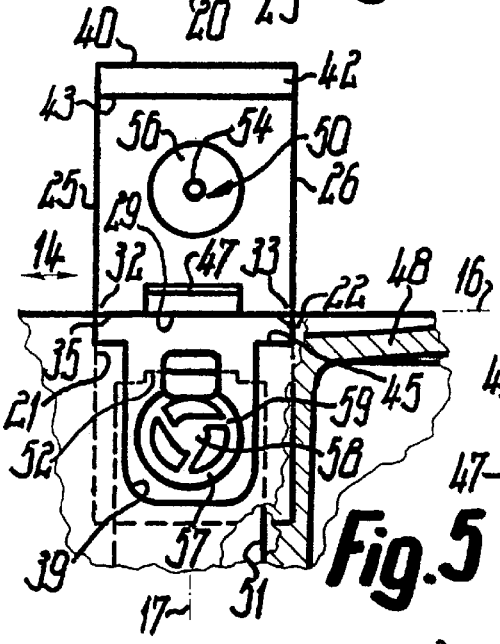
FIG. 5 is the detail of FIG. 4 in a view from the left.

All parts of the module shown in FIG. 1 are made in one part, particularly the components 2, 3 and namely the cup-shaped discharge or actuating head 2 of the piston unit of a pump of the aforementioned type and the second component 3 to be received by component 2. What is said for each individual component 2 and 3 may also apply for the other component. In the first position or casting state part 3 protrudes in a way totally free beyond component 2 to which it is immovably connected only by a tacking, nominal severing point or joint 4. Only after joint 4 has been severed or destroyed part 3 may be displaced relative to part 2 until its outermost faces adjoin the associated outermost faces of part 2 flush and without gaps to form an uninterrupted continuation of these faces.

An assembly or shear guide 5 on part 2 directly connects to and partly receives tacking 4. Assembly reception 5 serves for displacing part 3 and has a first length section forming a die 6 corresponding to a stamp tool. The leading end of part 3 directly and solely adjoining die 6 is the associated slide or punching ram 7. Thus tacking 4 is smoothly sheared off with the start of the mutual motion. Guide 5 is directly juxtaposed with the inside of outermost shell 8 of part 2. An inner shell 9 freely and codirectionally protrudes within shell 8 while being radially spaced from shell 8. Shell 9 is shorter or set back relative to shell 8 and serves to firmly seat the shaft of a piston unit which is traversed by an outlet duct porting into shell 9. The center axis 10 of part 2 is then the center axis of the pump. The medium emerges out of part 2 to the open in an axis 11 oriented at right angles transverse to axis 10.

Figure 4:
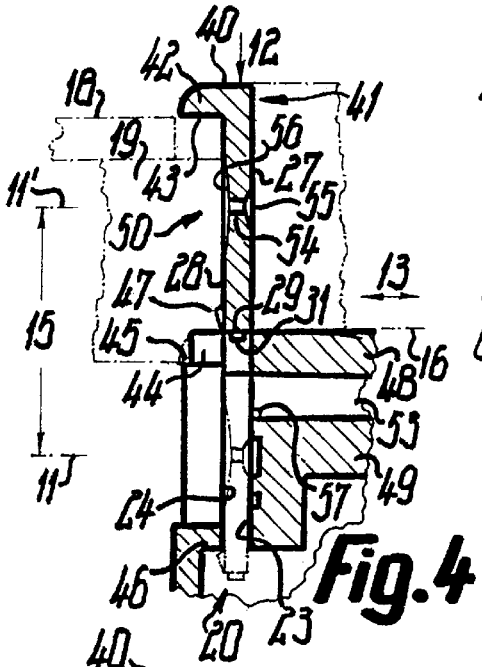
FIG. 4 is an enlarged detail of FIG. 1 with the operating posture indicated in dot-dashed lines.

For being transferred into the second position or operating posture part 3 is linearly shifted parallel to axis 10 in direction 12, namely counter the flow direction in shell 9, until the outlet axis attains second position 11 from first position 11'. In the first position as well as in the second and all other positions located inbetween part 3 is guided on part 2 with zero transverse clearance as referred to direction 12, though a transverse clearance of maximally two or one tenth of a millimeter may be included. Thus the mutual positions of parts 2, 3 are precisely defined over the full travel or displacement path 15. In the casting position parts 2, 3 interconnect in a plane 16 oriented at right angles transverse to direction 12. Joint 4 extends beyond plane 16 in direction 12 only by the cited edge dimension of connecting members. Middle plane 17 is oriented at right angles transverse to plane 16 or parallel to axis 11, 11' which is parallel to plane 16. Plane 16 is an axial plane of axes 10, 11 or a plane of symmetry of part 2 or 3. In FIG. 4 a part of the tool 18, 19 respective injection mold or of the tool pulls is shown in dash-dotted lines. In FIG. 4 is likewise shown the second postion of part 3 in which parts 2, 3 are mutually postionally secured by securing or locking means 20.

Guide 5 is in cross-section flat and rectangular. Thus guide 5 is bounded by four guide faces 21 to 24 interconnecting at right angles and each located in a single plane. With each of these faces a corresponding slide or guide face 25 to 28 of flat plate 7 is associated to serve as a counter face. Each of faces 25 to 28 is likewise uninterruptedly located in a single plane. Two remote faces are entirely parallel edge faces 25, 26. The two other faces are the large plate surfaces 27, 28. All faces 25 to 28 connect to a leading front or breast face 29 facing in direction 12. Face 29 is the frontmost edge face of the punch 7.

The edges formed by faces 21 to 24 in plane 16 form a continuous and uninterrupted sharp edge. This shearing edge is connected in one part and in plane 16 to the sharp edges formed by faces 25 to 29 via a microjoint 30 belonging to the nominal severing point. Joint 30 has a thickness of less than one or half of a tenth of a millimeter. Additionally to tacking 30 the joint 4 has only two connections opposing each other. These connections or members 31 protrude maximally 1 ½ tenth of a millimeter beyond the inner face 21, 22 or face 29 and connect to each of faces 21, 22, 29 in one part. From the cited edges of punch 7 the faces 25 to 28 form edges 32 to 35 commonly with face 29. Each member 31 forms a continuation of one of edges 25, 26 and in direction 12 decreasingly protrudes beyond the associated face 21 or 22. Member 31 connects in one part to this face 21 or 22 continuously with a joining face 36. Member 31 connects to face 29 with a likewise continuous face 37. Thus joining legs of equal lengths 36, 37 are formed. Member 31 is rectangularly triangular in cross-section and forms a planar base edge 38 directly connecting faces 21, 29 respective 22, 29. Faces 32 to 34, 36 provide connecting zones.

Face 24 faces axis 10 and is U-shaped when seen in direction 13. For that face 24 is formed by a corresponding projection 39 of part 2. Thus part 3 is guided with face 28 only along marginal strips which connect to faces 25, 26 and 29. These strips also hold face 28 in the operating posture. For translation into the operating posture part 2 has a pressure face 40 which faces away from face 29. Face 40 is formed by the trailing end remotest from joint 4. Except for penetrations and a thickening 41 the part 7 has continuously constant peripheral cross-sections. Thickening 41 is a protrusion 42 facing away from axis 10 toward the outer circumference of part 2. Protrusion 42 forms the significantly shorter leg of angular plate 3. Protrusion 42 juts only beyond face 28 and forms by its inside a stop 43 which faces joint 4. Part 2 forms between faces 21, 22 a recessed pocket 44 which connects to plane 16 in direction 12. Pocket 44 completely receives projection 42. For this purpose the side legs of protuberance 39 are spacedly set back from plane 16 in direction 12 so that their free ends form the pocket bottom or a counterstop 45 for stop 43. In the operating posture face 40 is located in plane 16. The sides 25, 26 of the projection 42 then smoothly adjoin the side faces 21, 22 of pocket 44 without gaps.

Locking means 20 include snap members 46, 47 which while attaining the operating posture are countersunk within part 2 and resiliently snap back into interengagement to then positively backclasp each other. Locking member 46 of part 2 is located at the inside of shell 8, at the end of guide 5 and in junction to face 24 which is farer spaced from axis 10. Member 46 is formed by an internal or shoulder face oriented transverse to direction 12. Locking member 47 of part 3 protrudes counter direction 12 increasingly beyond face 28, adjoins face 29 or edge 35 but not joint 30 and forms by its thickest zone a securing edge for contacting catch shoulder 46. A corresponding member 47 could also protrude beyond face 27. The ends of member 31 are laterally spaced from the respective opposing face 23 or 24 by at least one tenth of a millimeter. The length of member 31 between faces 23, 24 is at least twice as large as the length of legs 36, 37.

Figure 2:
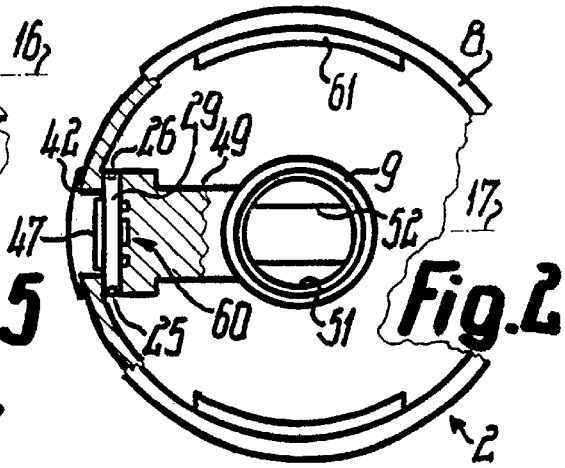
FIG. 2 is the module of FIG. 1 in a partial cross-sectional view from below.

Plane 16 is defined by the outside of an end wall 48 from which shells 8, 9 freely project in one part only in direction 12. This outside is the pressure handle for actuating the dispenser. The outside of shell 9, the inside of shell 8 and the inside of end wall 48 are interconnected via a projection 49 which is traversed by guide 5 closer to shell 8 than to shell 9 and entirely receives part 3 in the operating position. Then part 3 protrudes according FIG. 4 with members 31, 47 over the transverse web 46, 49 in direction 12. Projection 49 also forms member 46. Member 49 forms the longer part of guide 5 in junction to opening 6 which traverses wall 48. This longer part is then bounded only by faces 23, 24 but not by faces 21, 22, since projection 49 has in this portion a width which is equal to the spacing between faces 25, 26. Thus faces 25, 26 are freely exposed in this portion when in the operating posture. Member 47 is located between faces 25, 26 and can pass without contact between the side legs of protrusion 39. Projection 49 is T-shaped in axial view of FIG. 2. The cross web of this T is traversed by guide 5 and the T-foot adjoins shell 9.

Part 3 forms the dispenser's medium outlet 50 directly issuing into the environment. Outlet 50 is spaced from and located between the side legs of the protrusion 39. The interior of shell 9 forms a medium duct 51 of circular cross-section. Duct 51 transits at the bottom or at the inside of wall 48 into a constricted transverse groove 52 and is to be connected to the outlet duct of the piston shaft. The radially acting guide groove 52 adjoins a transverse duct 53 oriented radially to axis 10. Duct 53 traverses projection 49 up to face 23. In the operating position duct 53 sealingly adjoins face 27 or opening 50. Duct 53 is then eccentric to axis 11 in being closer to plane 16.

Plate 7 is traversed by a duct 54 with a spacing from and at a location between faces 25, 26 and faces 29, 43. Duct 54 is conically flared in or counter flow direction and has a diameter of less than one or half a micrometer. Duct 54 is bounded in one part by plate 7 and forms in plane 17 the nozzle duct of an atomizer nozzle by having sharp end edges. A shallow spherical cup recess 55 is provided in face 27. In face 28 a corresponding spherical cup recess 56 is provided, which has the same depth but significantly greater width. Duct 54 is two to four times longer than this depth or twice thereof. The ends of duct 54 connect to the centers of dishes 55, 56.

Guide means for the medium are associated with outlet 50 and connect to the upstream end of duct 54 to provide a swirler which urges the medium into a rotational flow about axis 11 while guiding the medium with this rotation directly into duct 54. For this purpose guide recesses 57 to 59 are provided only in face 23 or, where necessary, also only in face 27 or in both faces. The width or depth of recesses 57 to 59 are less than two, one or half a millimeter. In axis 11 a circularly annular recess 57 is included. Within chamber 57 a central circular cup recess 58 is provided. Plural, particularly at least three, transverse or tangential ducts 59 are uniformly distributed about axis 11 and connect recess 57 tangentially to swirl chamber 58. All recesses 57 to 59 have a common planar bottom face. The width of ducts 59 is smaller than the width or breadth of recesses 57, 58. The breadth of recess 57 is smaller than the width of chamber 58. Duct 53 issues directly only into duct 57, namely circumferentially spaced from and between two ducts 59. The width of chamber 58 is the same as the width of recess 50 so that they are operationally coincident. The medium thus flows out of duct 53 between faces 23, 27 initially only in opposite circumferential directions into duct 57 before then flowing via ducts 59 radially inwards into chamber 58.

In production the unit 1 is injection molded in die 18, 19. Then, a die segment 18 molding face 43 and an adjoining portion of face 28 is retracted whilst the remaining die segments which mold faces 25 to 28 remain in place or are lifted only briefly for loosening before then being returned to their casting position. Simultaneously the die segment which molds guide 5, face 29 and members 31 is retracted to free guide 5. With a tool punch, for example the die segment molding face 40, the face 40 is then urged in direction 12 until joint 30 and legs 36 are sheared off in the plane of faces 21, 22 analogous to shear-cutting. Thereby the cutting edges are formed by the U-shaped edge 32 to 34 and the corresponding U-shaped edge of opening 6. This edge is located in plane 16. The die segment molding member 47, pocket 44 and the gap between the side legs of the protrusion 39 may thereby also be slightly retracted to allow member 47 to pass without damage. The sheared-off members 31 remain totally on face 29 whilst the associated parting or division faces 36 serve to guide faces 25, 26 which do not form a free angle but define throughout a cutting clearance tending to zero.

Figure 3:
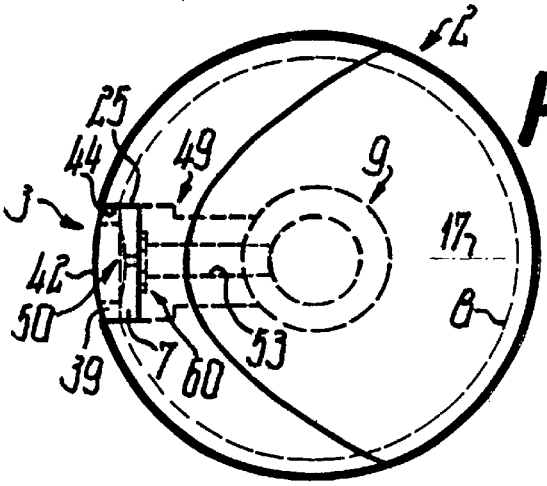
FIG. 3 is the module of FIG. 1 in plan view.
Figure 6:
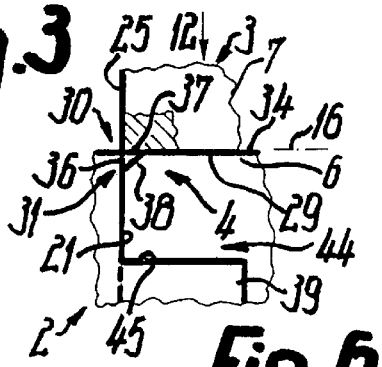
FIG. 6 is a further enlarged detail of FIG. 5.

With increasing displacement along path 15 also die segment 19 is retracted as a whole or progressively in portions to allow projection 42 to pass while segment 19 still maintains support and guidance on face 28 before immersing into guide 5. When reaching the cross web of protrusion 39 the member 47 urges this cross web back against its inherent resiliency. Thus member 47 passes by and snaps behind face 46 at the end of path 15. The convexly curved edge of projection 42 then forms, as viewed axially in FIG. 3, an uninterrupted continuation of the outer circumference of part 2. Over path 15 the duct 54 runs past the port of duct 53 and past duct 57 until it has attained the position coincidental with chamber 58. The workpiece 1 may then be totally demolded, i.e. released from the die.

Each of faces 23, 27 may exclusively have a protuberance or bead for contacting the counter face with increased pressure. The bead may be annular about axis 11. Thus ducts 53 and 57 to 59 or their openings in face 23 are located within this bead. If beads are provided on both faces 23, 27 they should be radially juxtaposed and support on each other with their side flanks under pressure. Thus an even better seal is achieved between faces 23, 27.

Shell 8 has at its inner circumference protruding catch or snap members 61 of withdrawal preventing means, which positively prevent unit 1 from being pulled off after having been axially plug-connected with the pump. While being plug mounted the members 61 are urged outwardly by inclined faces which run against counter-members and move radially due to the inherent resiliency of unit 1. Thereafter members 61 snap back with their stop faces behind corresponding counter faces of the pump's base body. Members 61 are provided only in an axial plane of axis 10, which plane is perpendicular to plane 17. The outside of wall 48 may be provided with a recess which does not reach up to guide 5 and provides the actuating handle.

It will be appreciated that the cited features and effects may be provided precisely as described, or merely substantially or approximately so and may also greatly deviate therefrom, depending on the particular requirements. On the basis of an outer diameter of part 2 of maximally 30 mm or 20 mm and a, as compared thereto, greater length of maximally 40 mm or 30 mm the dimensional relationships as shown are particularly favorable.

What is claimed is:

1. A dispenser for expelling media, comprising:

a module (1) having at least two interconnected components (2, 3) which are to be separated and then further assembled to form an operating assembly, said at least two components (2, 3) including first and second components (2, 3) which prior to separation are interconnected by a joint including a severing point (4, 30), and wherein said first and second components form connecting zones (32 to 34, 36) along said joint, and wherein at least one of said components (2, 3) provides a connecting zone including a shear zone (32 to 34) for sliding separation in a shear direction relative to the other connecting zones as said joint is severed at the severing point (4, 30) by a shearing motion, and wherein said joint has a thickness that has been limited so as to allow clean separation of said components (2,3) by a shearing motion; and wherein said first component is a casing part (2) for a medium dispenser and wherein said second component is a medium duct body (3) having a medium duct (54) with an inlet for receiving at least one medium and with an outlet for transmitting at least one medium, said medium duct body (3) being insertable in said casing cart (2) to form an operating assembly for dispensing media after severing of said joint.

2. The dispenser according to claim 1, wherein said module (1) includes a duct unit for guiding the medium, said duct unit including a passage duct (54 to 58) bounded by at least one of said components (2, 3).

3. The dispenser according to claim 1, wherein said shear zone and said first and second components (2, 3) include first and second shear faces (21 to 23 and 25 to 27) directly sliding on each other when separated and after entirely shearing said second component (3) off from said first component (2).

4. The dispenser according to claim 3, wherein said severing point (4, 30) directly connects to said first shear faces (21 to 23) of said first component (2), said second component (3) including a breast face (29) oriented transverse to at least one of said first and second shear faces (21 to 23 and 25 to 27) and directly connecting to said severing point (4, 30), said first shear faces (21 to 23) and said breast face (29) together defining point faces.

5. The dispenser according to claim 4, wherein at least one of said point faces is an edge face.

6. The dispenser according to claim 1 and further defining a shear motion (12) and cross directions (13, 14) oriented transverse to said shear motion (12), wherein a shear guide (5) is included for positionally securing said second component (3) with respect to said first component (2) substantially without motion play with respect to at least one of said cross directions (13, 14), said shear guide (5) emanating from said shear zone (32 to 34) and mutually guiding said first and second components (2, 3) while performing said shear motion (12) away from said first position.

7. The dispenser according to claim 6, wherein said shear guide (5) defines only one single degree of freedom (12) after having left said first position.

8. The dispenser according to claim 1 and further including a shear guide (5) mutually guiding said first and second components (2, 3) when having left said first position toward a second position, wherein said shear guide (5) includes a guide duct (6) on said first component (2) and guide faces (25 to 27) on said second component (3), said guide faces (25 to 27) being complementary with respect to said guide duct (6).

9. The dispenser according to claim 1 and further including a shear guide (5) mutually guiding said first and second components (2,3) in said operating assembly, wherein said shear guide (5) defines a motion track (15) for said operating assembly, said shear guide (5) defining guide faces (24) laterally interspaced and shorter than said motion track (15).

10. The dispenser according to claim 1, wherein said second component (3) is assembled inside said first component (2) after separation, said second component (3) externally including remote faces (27, 28), said severing point (4) being spaced from at least one of said remote faces (27, 28), said at least one remote face (27, 28) extending inside said first component (2) after said second component (3) has been separated.

11. The dispenser according to claim 1, and further defining an assembly motion (12) for assembling said second component (3) to said first component (2), wherein said second component (3) defines a leading end (29) with respect to said assembly motion (12), said connecting zones (32 to 34, 36) being exclusively located at said leading end (29) when said second component (3) is located deeper inside said first component (2) than prior to separation.

12. The dispenser according to claim 1, and further defining an assembly guide (5) for mutually guiding said first and second components (2, 3) after separation, with said second component (3) moving along an assembly track (15) of said first component (2), wherein said first and second components (2, 3) define a cover side (24) where said assembly guide (5) and said first component (3) only partly cover said, second component (3) with respect to at least one of said assembly track (15), and said assembly (2, 3), said second component (3) circumferentially guidingly contacting the medium downstream of and separate from said first component (2).

13. The dispenser according to claim 12, wherein said cover side (24) defines two cover zones which are mutually laterally spaced, said assembly guide (5) covering said second component (3) at said cover zones but not covering said second component (3) between said cover zones.

14. The dispenser according to claim 12, wherein said second component (3) defines a leading end section, when in said assembly, said assembly guide (5) transversely covering said leading end section at said covering side (24) said second component (3) being located downstream of said first component (2).

15. The dispenser according to claim 1, wherein said second component (3) is traversed by said duct (54) including a narrowest section which is conical, said duct (54) directly guiding the medium downstream of said first component (2).

16. The dispenser according to claim 15, wherein said duct (54) includes a downstream end, a shallow recess (56) being included and including a recess bottom, said downstream end connecting to said recess bottom.

17. The dispenser according to claim 15 and further defining a cross-sectional thickness of said second component (3) in the vicinity of said duct (54), wherein said duct (54) extends over a duct length bigger than half of said cross-sectional thickness.

18. The dispenser according to claim 1 and further defining a departing direction (12) while transferring said second component(3) from said first position to a second position, wherein said first component (2) comprises a duct recess (57 to 59) directly covered by said second component (3) when extending inside said first component (2), a flow direction of the medium and a flow plane oriented substantially parallel to said departing direction (12) being defined, within said duct recess (57 to 59) said flow direction being parallel to said flow plane.

19. The dispenser according to claim 18, wherein said duct recess (57 to 59) is bounded by guide faces for turbulencing the medium.

20. The dispenser according to claim 18, wherein said duct recess (57 to 59) includes a central chamber section (58) and said second component (3) includes a chamber recess (55) substantially coincidentially covering said chamber section (58).

21. The dispenser according to claim 1, wherein said second component (3) is a plate including at least one thickening (41) which is not commonly both annular and peripheral.

22. The dispenser according to claim 21 and further defining an individual plate face (28) of said plate (3), said thickening (41) projecting exclusively over said individual plate face (28).

23. The dispenser according to claim 21 and further including a pressure face (40) for introducing a severing force while severing said severing point (4, 30), wherein said thickening includes said pressure face (40).

24. The dispenser according to claim 1 and further including an assembly reception (5) mutually positionally orienting said first and second components (2, 3) when in said operating assembly, wherein locking means (20) are included for substantially positively interlocking said first and second components (2, 3), said locking means (20) including interengaged connecting members (42, 44, 46, 47) separate from said assembly reception (5).

25. The dispenser according to claim 24, wherein said connecting members include complementary snap members (46, 47) resiliently interengaged prior to reaching said operating assembly.

26. The dispenser according to claim 1 and further defining an assembly path (15) for assembling said first and second components (2, 3) into said operating assembly, wherein a stop (43) and a counter-stop (45) are included for mutually stop-limiting said first and second components (2, 3) when in said operating assembly, said counter-stop (45) including laterally interspaced individual counter-stops commonly abutting said stop (43).

27. The dispenser according to claim 26 and further defining a trailing end of said second component (3), wherein said trailing end includes said stop (43), when in said operating assembly said second component (3) extending inside said first component (2).

28. The dispenser according to claim 26 and further including a reception pocket (44) on said first component (2), wherein said reception pocket (44) is bounded by lateral pocket flanks, said stop (43) laterally directly connecting to at least one of said pocket flanks substantially only when having reached said operating assembly.

29. The dispenser according to claim 1 and further including means for shaping said module (1) by injection molding in a molding die (18, 19), said shaping means being provided for molding said first and second components (2, 3) commonly and in one part, wherein said module (1) includes cutting means for shear cutting said severing point (4, 30) without any cutting tools separate from said module (1).

* * * * *

UNITED STATES PATENT AND TRADEMARK OFFICE

CERTIFICATE OF CORRECTION

PATENT NO. : 6,257,461 B1
DATED : July 10, 2001
INVENTOR(S) : Karl-Heinz Fuchs

It is certified that error appears in the above-identified patent and that said Letters Patent is hereby corrected as shown below:

Column 1,
Line 28, "positon" should be -- position --.

Column 3,
Line 3, "cross-sectinally" should be -- cross-sectionally --.
Line 35, "20º" should be -- 2º --.
Line 41, "postion" should be -- position --.

Column 9,
Line 16, "said, second" should be -- said second --.

Signed and Sealed this

Twenty-third Day of July, 2002

*Attest:*

*Attesting Officer*

JAMES E. ROGAN
*Director of the United States Patent and Trademark Office*